United States Patent [19]

Scherer

[11] 4,163,344

[45] Aug. 7, 1979

[54] OVEN HINGE MECHANISM INCLUDING CAM BALANCE MODIFIER

[75] Inventor: Richard M. Scherer, Oxford, Miss.

[73] Assignee: Chambers Corporation, Osford, Miss.

[21] Appl. No.: 858,642

[22] Filed: Dec. 8, 1977

[51] Int. Cl.[2] ..... E05F 1/10

[52] U.S. Cl. ..... 49/386; 126/191; 126/194; 49/389

[58] Field of Search ..... 49/386, 381, 389; 126/194, 191; 312/276, 319

[56] References Cited

U.S. PATENT DOCUMENTS

| | | | |
|---|---|---|---|
| 2,425,365 | 8/1947 | Davidson | 49/386 X |
| 3,003,495 | 10/1961 | Coultrip | 126/194 |
| 3,150,659 | 9/1964 | Ellis et al. | 126/194 |
| 3,677,259 | 7/1972 | Doner | 126/194 |
| 3,955,865 | 5/1976 | Wilson | 49/386 X |
| 4,001,973 | 1/1977 | Rice et al. | 49/386 |

*Primary Examiner*—Philip C. Kannan

*Attorney, Agent, or Firm*—Richards, Harris & Medlock

[57] ABSTRACT

A hinge mechanism is provided for use with an oven housing having side walls, a rear wall, an access opening opposite the rear wall and a door for the access opening wherein the door is movable through a plurality of positions between a closed position and an open position. The hinge mechanism includes a bracket rigidly mounted to the side wall of the oven structure for pivotally securing the door to the side wall of the oven housing. The bracket includes specifically designed camming surface along the top edge. A lever is pivotally secured to the door and includes first and second arm members. A spring having first and second ends is provided for biasing the lever toward the side wall of the oven housing. The first end of the spring is attached to the first arm member of the lever, and the second end of the spring is attached to the side wall of the oven housing adjacent the bracket. The second end of the lever includes a cam follower for engaging the camming surface of the bracket. The lever acting on the camming surface is operative to counterbalance the door so that the door can be balanced at desired positions between the door closed and open positions, and so that the door can be maintained in an unbalanced state at the ends of the door swing. The counterbalancing effect of the lever increases as the door moves from the door closed position to the door open position to match the force delivered by the spring as the spring extends due to the door moving from the door closed position to the door open position.

4 Claims, 7 Drawing Figures

OVEN HINGE MECHANISM INCLUDING CAM BALANCE MODIFIER

FIELD OF THE INVENTION

This invention relates to door structures, and more particularly to hinge mechanisms for counterbalancing the door as the door moves from a closed position to an open position.

THE PRIOR ART

Typically, oven doors are mounted to an oven housing using various hinge mechanisms to allow pivotal movement of the door. Usually such mechanisms utilize a spring extending between the hinge mechanism and a side wall of the oven housing to bias the hinge mechanism in order to maintain the oven door in a vertical closed position. In the course of opening the door, the resistance provided by the spring must be overcome as the door moves from the closed position through a plurality of positions to a substantially horizontal open position. The force to overcome the resistance of the spring varies depending upon the position of the door with respect to the closed position, making it difficult to properly counterbalance the door to maintain a plurality of desired stationary positions. For example, the forces exerted by the spring on certain prior oven doors may cause the door to snap back prematurely to the closed position unless the door has been sufficiently opened to overcome this spring resistance force.

Previously developed hinge mechanisms for oven structures are described and claimed in U.S. Pat. No. 3,003,495 to Coultrip, entitled "Hinge Construction" issued Oct. 10, 1961; U.S. Pat. No. 2,800,128 to Chesser, entitled "Hinge For Oven Door" issued July 23, 1957; U.S. Pat. No. 2,425,365 to Davidson, entitled "Counterbalanced Door Structure" issued Aug. 12, 1947; and U.S. Pat. No. 2,313,582 to Rees, entitled "Door Structure" issued Mar. 4, 1941. However, such prior hinge mechanisms have not provided an oven door with the capability of being balanced in a plurality of positions between the door closed and open positions through which an oven door moves. Furthermore, such prior hinge mechanisms have required several components requiring high labor and material costs, and have been therefore subject to repair and maintenance problems.

A need has thus arisen for a hinge mechanism for an oven which will maintain an oven door in a balanced state in a plurality of desired positions between the door closed position and the door open position, and in which the door is maintained in an unbalanced state at the ends of the door swing. Moreover, a need has arisen for a hinge mechanism that will permit the opening and closing of an oven door with a minimum of effort in which the force required to move the door is essentially constant through all positions between the closed position to the open position. Furthermore, a need has arisen for a hinge mechanism for an oven structure that is simple in construction, requiring a minimum number of components and which minimizes the stress on the hinge components, in addition to minimizing labor and material costs while insuring the reliability of the mechanism.

SUMMARY OF THE INVENTION

In accordance with the present invention, a hinge mechanism for an oven door is provided which maintains the door in a balanced state in a plurality of positions between the door closed position and open position through which the door moves from a closed position to open position and maintains the door in an unbalanced state at the ends of the door swing. The hinge mechanism further permits the oven door to be positioned with a minimum of effort and force.

In accordance with the present invention, a hinge mechanism for use with an oven housing having side walls, a rear wall, an access disposed in a substantially vertical plane opposite the rear wall and a door for the access opening, wherein the door is movable through a plurality of positions between a vertical closed position and a substantially horizontal open position includes a bracket rigidly mounted to the side wall of the oven housing. The bracket pivotally secures the door to the side wall of the oven housing and includes a camming surface along the top edge thereof. A lever is pivotally secured to the door and includes first and second arm members. A spring having first and second ends for biasing the lever toward the side wall of the oven housing is provided. The first end of the spring is attached to the first arm member on the lever, and the second end of the spring is attached to the side wall of the oven housing adjacent the bracket. The second end of the lever includes a cam follower for engaging the camming surface of the bracket. The lever acting on the camming surface is operative to counterbalance the door, so that the door can maintain a balanced state at desired position between the fully closed or open positions and so that the door can maintain an unbalanced state at the ends of the door swing. The counterbalancing effect of the lever increases as the door moves from the door closed position to the door open position to match the force delivered by the spring as the spring extends due to the door moving from the door closed position to the door open position.

In accordance with another aspect of the present invention, a hinge mechanism for use with an oven housing includes a bracket rigidly mounted to the side wall of the oven housing. The bracket includes a camming surface on its top edge and an arm member. A hinge bracket having first and second ends is provided wherein the second end is pivotally secured to the arm member of the bracket. A channel frame is secured within the door and is adapted to receive the hinge bracket for rendering the door pivotally cooperative with the hinge bracket for movement between a door closed position and a door open position. The hinge mechanism further includes a lever having first and second ends. The first end of the lever is pivotally secured to the hinge bracket between the first and second ends thereof. The second end of the lever includes first and second arm members disposed on opposite sides of the lever to form a substantially T-shaped structure on the second end of the lever. A spring is provided having first and second ends for the biasing the lever toward the side wall of the oven housing. The first end of the spring is attached to the first arm member of the lever, and the second end of the spring is attached to the side wall of the oven housing to a point remote from the bracket. The second arm member of the lever includes an anti-friction roller mounted for rotation about a fixed axis secured to the second arm member for engaging the camming surface of the bracket. The lever acting on the camming surface is operative to counterbalance the door. The counterbalancing effect of the lever increases as the door moves from the door closed position to the door open position to match the force delivered by the spring as the spring extends due to the door moving from the door closed position to the door open position.

DESCRIPTION OF THE DRAWINGS

For a more complete understanding of the present invention and for further objects and advantages thereof, reference is now made to the following detailed description taken in conjunction with the accompanying drawings, in which.

DESCRIPTION OF THE PREFERRED EMBODIMENT

Figure 1:
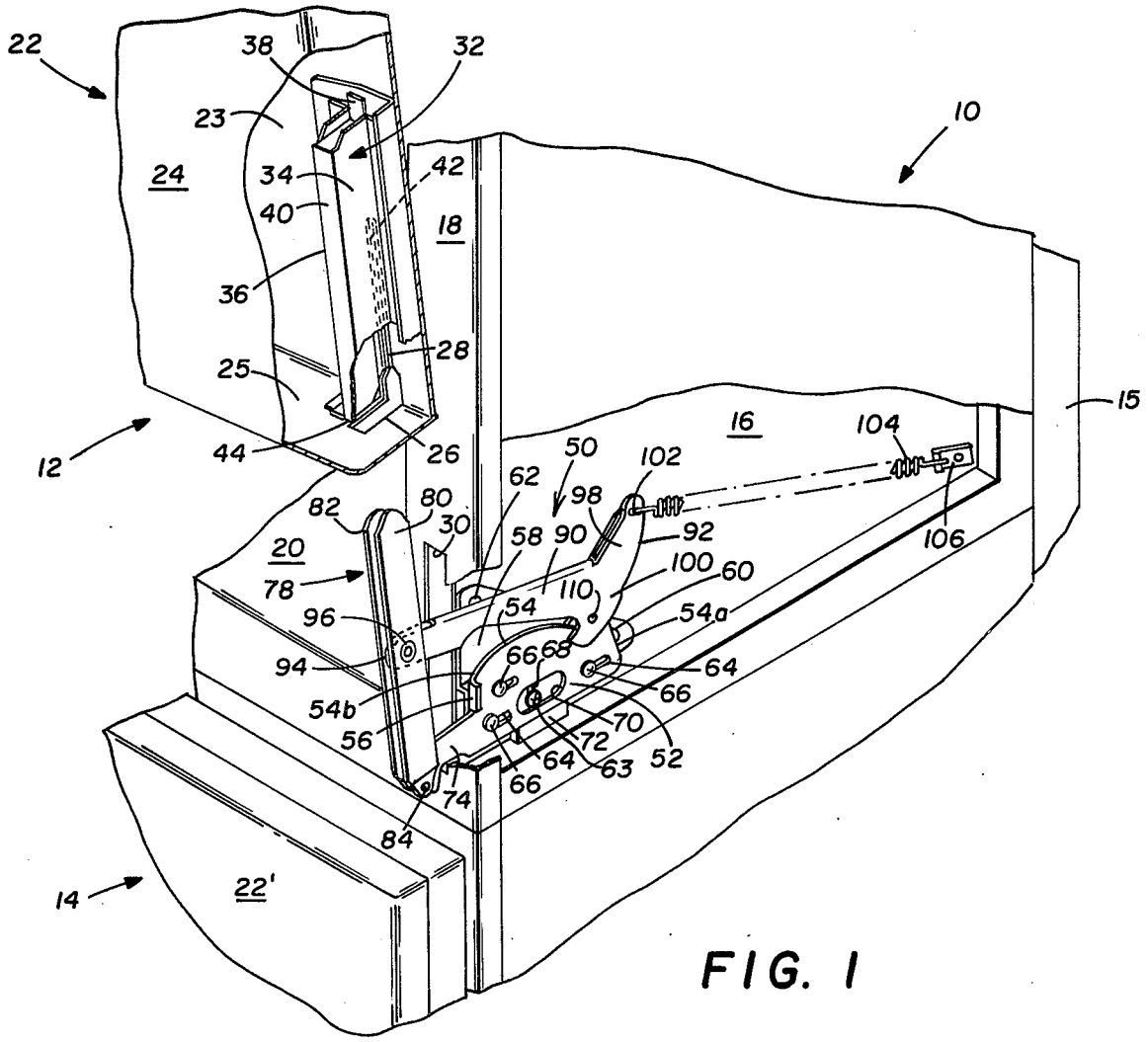
FIG. 1 is a perspective view of the hinge mechanism of the present invention attached to an oven structure and an internal perspective view of the door channel frame.

FIG. 1 illustrates a typical oven, generally identified by the numeral 10. Oven 10 includes an upper oven and a lower oven, generally identified by the numerals 12 and 14. Upper oven 12 includes a rear wall 15, side wall 16 and a front wall 18. Front wall 18 of upper oven 12 includes an access opening 20 to permit access to the interior of the upper oven 12. Access opening 20 is provided with a door, generally identified by the numeral 22. Similarly, the lower oven 14 is provided with a similar door 22'.

Door 22 is of the swing-down type, and is pivotable about a lower horizontal axis. The door 22 is movable through a plurality of positions between a vertical closed position in which the door 22 abuts against front wall 18 to close the access opening 20 and a substantially horizontal open position in which door 22 is substantially perpendicular to front wall 18 to provide access to the interior of the oven 12. The door 22 includes an inner panel 23, an outer panel 24 and a bottom panel 25. Bottom panel 25 includes an aperture 26, and inner panel 23 includes an elongated aperture 28. When door 22 is mounted to upper oven 12, aperture 28 aligns with an aperture 30 within front wall 18 of the upper oven 12.

Door 22 further includes a channel frame generally identified by the numeral 32, through which door 22 is mounted to the side wall 16 of the upper oven 12 for pivotal movement between the closed and open positions. Channel frame 32 comprises a rectangular body having side walls 34 and 36 and end walls 38 and 40. End wall 38 of channel frame 32 includes an elongated aperture 42, which communicates with aperture 28 of inner panel 23. Channel frame 32 is permanently affixed to inner panel 23 and bottom panel 25 of door 22 by riveting, welding or the like to secure channel frame 32 against movement relative to door 22. Channel frame 32 further includes a bottom aperture 44, which communicates with aperture 26 contained within bottom panel 25 of door 22.

Figure 2:
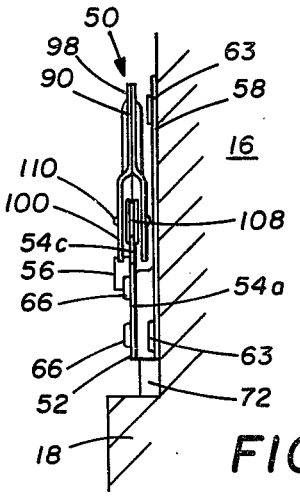
FIG. 2 is a rear end view of the hinge mechanism, showing the engagement of the cam follower with the camming surface.

Referring simultaneously to FIGS. 1 and 2, wherein like numerals are utilized for like and corresponding components, the hinge mechanism of the present invention is illustrated and is generally identified by the numeral 50. Hinge mechanism 50 includes a bracket 52 having a camming surface 54. Camming surface 54 extends from end **54*a* to end 54*b*. Adjacent end 54*b* of camming surface 54 is a finger 56 disposed substantially perpendicular to bracket 52. The operation of finger 56** will be subsequently described.

Bracket 52 is rigidly affixed to side wall 16 of upper oven 12 using a mounting bracket 58 for maintaining bracket 52 in a spaced apart relationship from side wall 16. Mounting bracket 58 includes apertures 60, 62 and 68 for receiving bolts 63 (FIG. 2) for permanently affixing mounting bracket 58 to side wall 16 and for allowing vertical adjustment of the entire hinge mechanism 50. Bracket 52 includes slotted apertures 64 for receiving bolts or screws 66 for affixing bracket 52 to mounting bracket 58. Through the use of slotted apertures 64, bracket 52 can be horizontally positioned and adjusted with respect to a position on mounting bracket 58. Bracket 52 further includes an aperture 70 for providing access to bolt 63 received by aperture 68 within mounting bracket 58. A support 72 is provided to allow for the vertical positioning of bracket 52 with respect to mounting bracket 58.

Bracket 52 further includes an extension arm 74, which extends through aperture 30 within front wall 18 of upper oven 12. A hinge bracket, generally identified by the numeral 78, having side walls 80 and 82 is pivotally attached to extension arm 74 using a pivot pin 84. It can be seen in FIG. 1 that channel frame 32 contained within door 22 is positioned and dimensioned to receive hinge bracket 78, such that side walls 80 and 82 of hinge bracket 78 communicate with the interior portions of side walls 34 and 36 of channel frame 32 when the door 22 is positioned on the hinge bracket 78. Door 22 is therefore rendered pivotally cooperative with hinge bracket 78 about pivot pin 84 through the insertion of hinge bracket 78 into channel frame 32. Door 22 therefore, is movable between the door closed position and the door open position as the door pivots about pivot pin 84.

Hinge mechanism 50 further includes a lever 90 having ends 92 and 94. End 94 of lever 90 extends through aperture 30 in front wall 18, and is pivotally attached centrally between side walls 80 and 82 of hinge bracket 78 using a pivot pin 96. End 92 of lever 90 includes arms 98 and 100, disposed on opposite sides of lever 90 to form a substantially T-shaped structure for the end 92 of lever 90. Arm 98 includes an aperture 102 for receiving one end of spring 104. The other end of spring 104 is affixed to a bracket 106. Bracket 106 is disposed adjacent the rear wall 15 of upper oven 12 and is permanently affixed to side wall 16 of upper oven 12.

Referring to FIG. 2, arm 100 of lever 90 includes a cam follower 108, which may comprise, for example, an anti-friction roller mounted to arm 100 using a pin 110. Cam follower 108 is operative to engage camming surface 54 of bracket 52. It therefore can be seen that lever 90 is biased to side wall 16 of upper oven 12 using spring 104 and is caused to move along camming surface 54 from end 54*a* to end 54*b* as door 22 is pivoted from the closed position to the open position. An important aspect of the present invention is that through the position of arms 98 and 100 of lever 90 and the configuration of camming surface 54 of bracket 52, door 22 is balanced in a plurality of positions between the door fully closed position and the door fully open position as the door moves from the closed position to the open position, yet the door is unbalanced at the ends of the door swing. Furthermore, the hinge mechanism 50 is designed to substantially match the forces delivered by spring 104 as door 22 is moved from the closed position to the open position, such that the force exerted to move door 22 through the plurality of positions between the closed and open positions remains constant. This constant force minimizes forces exerted on camming surface 54 and prevents door 22 from prematurely closing when near the closed position and from prematurely falling open when nearing the fully opened position.

It will be understood that although one hinge mechanism 50 has been described, a similar hinge mechanism will be disposed on the oven side wall opposite side wall 16 of upper oven 12 to hingedly attach the opposite side of door 22 to upper oven 12. Similarly, oven door 22' of lower oven 14 can be hingedly attached to the side walls of lower oven 14. Although extension arm 74 and end 94 of lever 90 have been shown as being pivotally connected to hinge bracket 78, which mates with channel frame 32 to pivotally attach door 22 to side wall 16, in the alternative, extension arm 74 and end 94 of lever 90 can be directly attached to door 22 to render door 22 pivotally attached to side wall 16 as is well known in the art.

Figure 3:
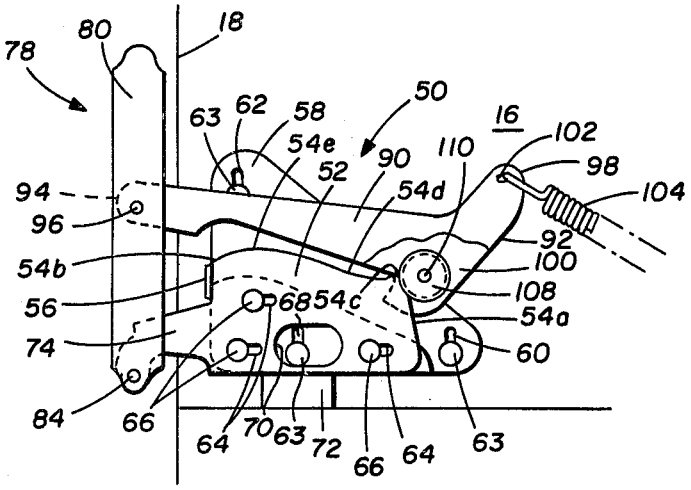
FIG. 3 is a side elevational view, partially in section, showing the position of the hinge mechanism when the oven door is in the fully closed position.

Referring simultaneously to FIGS. 3–6, wherein like numerals are utilized for like and corresponding components, the operation of the present hinge mechanism 50 will be described. Referring specifically to FIG. 3, hinge mechanism 50 is shown in the door closed position. Hinge bracket 78 is in a substantially vertical position to maintain door 22 (FIG. 1) in a substantially vertical position to close access opening 20 of upper oven 12 (FIG. 1). Lever 90 is positioned such that cam follower 108 engages end 54*a* of camming surface 54. The force exerted by cam follower 108 on camming surface 54 is sufficient to maintain door 22 in the vertical closed position. Furthermore, in the closed position spring 104 is maintained in its least extended configuration between arm 98 and bracket 106 attached adjacent rear wall 15 of upper oven 12 (FIG. 1).

Camming surface 54 includes a relatively short convex arcuate portion 54*c* adjacent end 54*a*. Disposed adjacent convex arcuate portion 54*c* is a relatively short concave arcuate portion 54*d* of camming surface 54, and disposed between concave arcuate portion 54*d* and end 54*b* of camming surface 54 is a relatively long convex arcuate portion 54*e*. As door 22 moves from the closed position to the open position, cam follower 108 moves along camming surface 54 through arcuate portions 54*c*, 54*d* and 54*e* to maintain door 22 in a balanced state in a plurality of positions between the door fully closed and fully open positions through which door 22 moves from the closed position to the open position. The reaction forces between cam follower 108 and camming surface 54 are minimized due to the relative position between arm 100 on which cam follower 108 is mounted and the connection point between lever 90 and hinge bracket 78. This configuration minimizes the forces exerted on the components of the hinge mechanism 50 as well as matching the linear forces delivered by spring 104 as it is extended as door 22 moves from the closed position to the open position.

Figure 4:
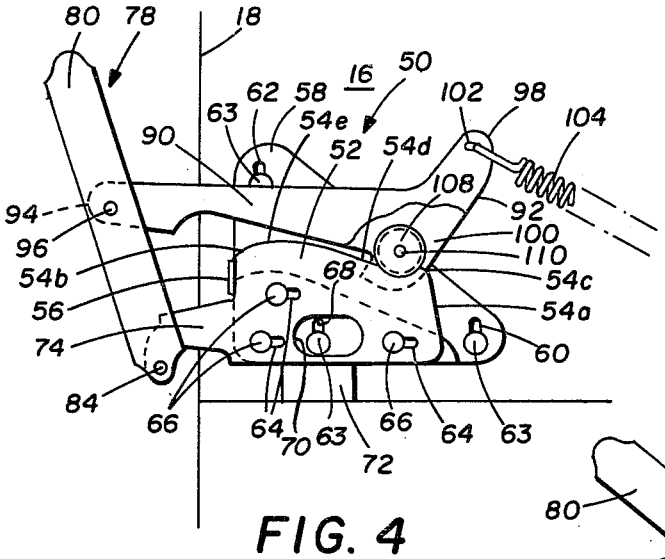
FIG. 4 is a side elevational view, partially in section, showing the position of the hinge mechanism when the door is in an initial open position.

Referring to FIG. 4, the position of the hinge mechanism 50 is illustrated when the door is in the ajar position, being displaced slightly from front wall 18 of the upper oven 12. It can be seen that cam follower 108 has moved along camming surface 54 from end 54*a* over convex arcuate portion 54*c* to a position within concave arcuate portion 54*d* of camming surface 54. While moving door 22 from the position illustrated in FIG. 3 to the position illustrated in FIG. 4, door 22 is in an unbalanced state. In FIG. 4 door 22 is maintained in a balanced state. In the position illustrated in FIG. 4, hinge bracket 78 has pivoted about hinge pin 84, and lever 90 has pivoted about pin 96 of hinge bracket 78. This pivotal motion of hinge bracket 78 and lever 90 has caused spring 104 to extend, thereby linearly increasing its counterbalancing force through lever 90 on door 22 to maintain door 22 in the position corresponding to the position of hinge bracket 78 shown in FIG. 4.

Figure 5:
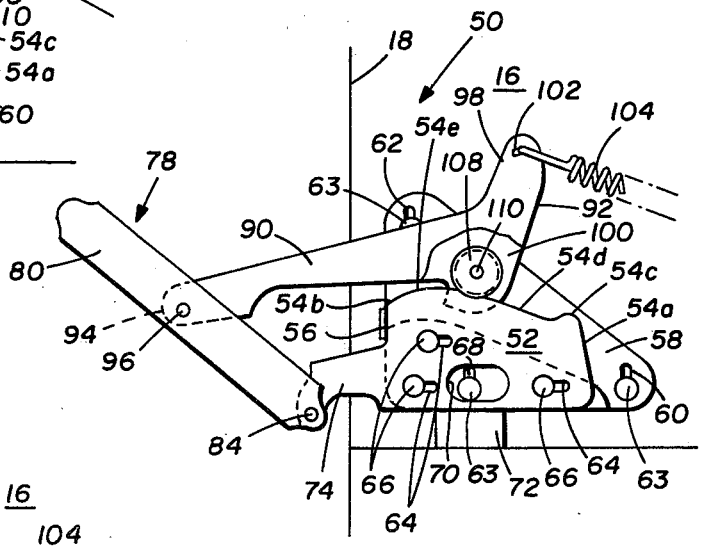
FIG. 5 is a side elevational view, partially in section, showing the position of the hinge mechanism when the door is positioned in an intermediate position between the door closed position and the door open position.

Referring to FIG. 5, door 22 has been moved to a position approximately halfway between the closed position and the open position. Cam follower 108 has now moved through the concave arcuate portion 54*d* to engage convex arcuate portion 54*e* of camming surface 54. Spring 104 has further extended to increase the counterbalancing forces exerted on hinge bracket 78 to maintain door 22 in a fully balanced state in the position shown.

Figure 6:
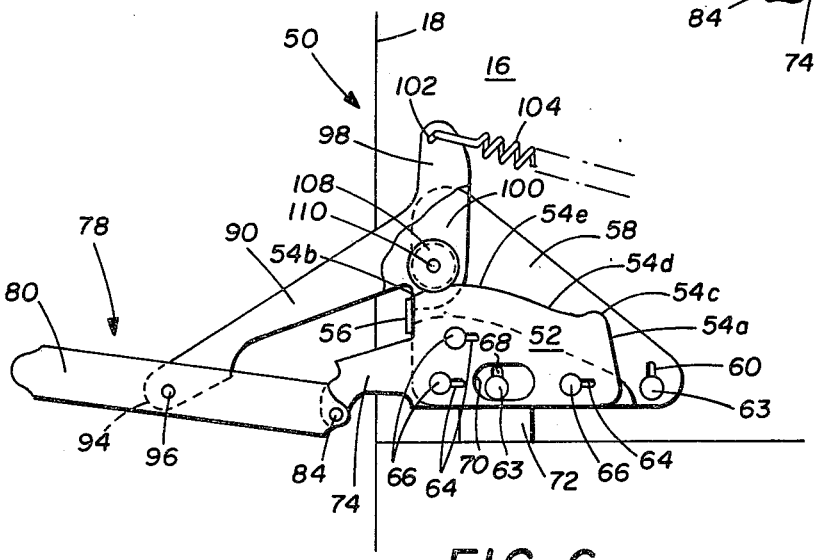
FIG. 6 is a side elevational view, partially in section, showing the position of the hinge mechanism when the door is in the fully open position.

FIG. 6 illustrates the final position of hinge bracket 52 in which door 22 is in its fully open position and in a slightly unbalanced state at this end of the door swing. Cam follower 108 has continued to move along convex arcuate portion 54*e* of camming surface 54 until arm 100 of lever 90 engaged finger 56 at the end 54*b* of camming surface 54. Therefore, it can be seen that finger 56 acts as a stop mechanism for preventing the travel of cam follower 108 past end 54*b* of camming surface 54. In the open position as illustrated in FIG. 6, hinge bracket 78 is in a substantially horizontal position having pivoted from the position shown in FIG. 3 to the position shown in FIG. 6 about pivot pin 84 of extension arm 74 of bracket 52. In the fully open position, spring 104 is in its fully extended position to exert its maximum counterbalancing force through lever 90 to hinge bracket 78 and door 22.

To move door 22 from the open position to the closed position, the reverse process is performed in which cam follower 108 moves from end 54*b* to end 54*a* of camming surface 54. As is the case in moving door 22 from the closed position to the open position, the reverse process also maintains door 22 in a balanced state between the door open position and the door closed position as door 22 moves through a plurality of positions from the open position to the closed position. The matching counterbalancing force decreases linearly as the forces delivered by spring 104 decrease as door 22 approaches the closed position.

Figure 7:
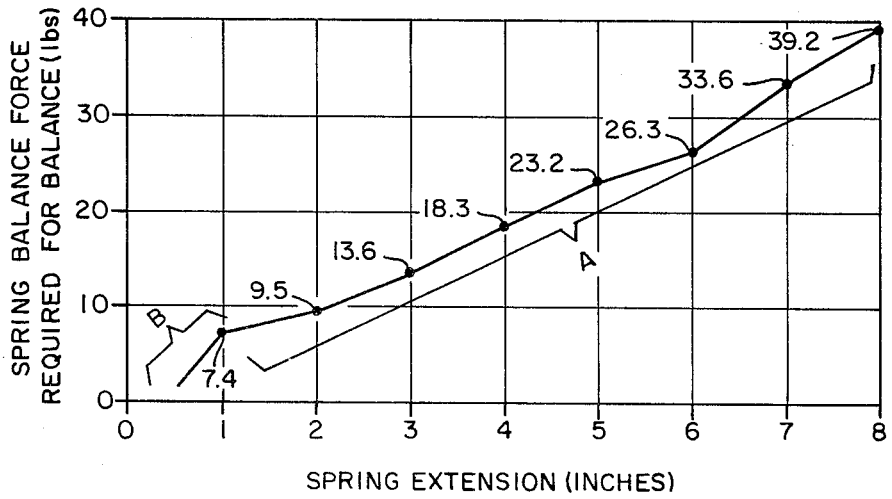
FIG. 7 is a graph of spring extension versus force delivered by the spring, demonstrating the linear relationship between the spring extension and the matching counterbalancing force exerted on the spring as the door moves from the closed position to the open position.

Referring to FIG. 7, a graphical representation of the extension of spring 104 in inches versus the counterbalancing force in pounds required to balance door 22 as door 22 moves from the closed position to the open position is illustrated. It can be seen that as the spring balance force increases as door 22 opens, the extension of spring 104 remains substantially linear between one inch of extension and eight inches of extension in the region designated by the letter "A". For example, when the spring is extended two inches, a force of approximately 9.5 pounds is exerted on the spring. This linear extension generates a counterbalancing force as door 22 moves through the plurality of positions from the closed position to the open position between the ends of the door 22 swing, which is a constant force, such that the door is maintained in a balanced state throughout these positions. From the graph of FIG. 7 it can be seen that the spring extension is slightly nonlinear between no extension and one inch of extension in the region designated by the letter "B". This nonlinear relation is caused by a slightly greater force necessary to move cam follower 108 from end 54*a* over convex arcuate portion 54*c* of camming surface 54 causing door 22 to be in an unbalanced state at this end of the door swing. This additional force is required to overcome the resistance offered by convex arcuate portion 54*c*, which maintains the door 22 in the closed position.

It therefore can be seen that the hinge mechanism of the present invention continuously maintains an oven door in a balanced state in a plurality of positions between a door closed position and a door open position and maintains the door in an unbalanced state at the ends of the door swing. The hinge mechanism of the present invention permits the opening and closing of an oven door with a minimum of effort, in which the force required to move the door is constant through positions between the closed position and the open position. The configuration of the components of the hinge mechanism is such that the forces experienced by the components is minimal to minimize wear and insure reliability of the mechanism.

Whereas the present invention has been described with respect to its specific embodiments thereof, it will be understood that various changes and modifications will be suggested to one skilled in the art, and it is intended to encompass such changes and modifications as fall within the scope of the appended claims.

What is claimed is:

1. For use with an oven structure having side walls, a rear wall, an access opening disposed in a substantially vertical plane opposite the rear wall and a door for the access opening, the door being movable through a plurality of positions between a vertical closed position where the door closes the access opening and a substantially horizontal open position to provide access to the interior of the oven structure, a hinge mechanism comprising:

bracket means rigidly mounted to the side wall of the oven structure having a camming surface on a horizontal top edge thereof and further including an integrally connected arm member;

said camming surface of said bracket means including a relatively long convex arcuate portion, a relatively short concave arcuate portion adjacent one end of said relatively long convex arcuate portion and a relatively short convex arcuate portion adjacent one end of said relatively short concave arcuate portion;

a hinge bracket having first and second ends, said second end thereof being pivotally secured to said arm member of said bracket means;

a channel frame secured within the door adapted to receive said hinge bracket for rendering the door pivotally cooperative with said hinge bracket for movement between the door closed position and the door open position;

a lever having first and second ends, said first end being pivotally secured to said hinge bracket between said first and second ends thereof, said second end of said lever including first and second arm members integrally connected to said lever and disposed on opposite sides of said lever to form a substantially T-shaped structure on said second end of said lever;

spring means having first and second ends for biasing said lever of the oven structure, said first end of said spring means being attached to said first arm member of said lever and said second end of said spring means being attached to the side wall of the oven structure to a point remote from said bracket means, said spring means lying in a plane substantially perpendicular to the rear wall of the oven structure;

said second arm member of said lever including an anti-friction roller mounted for rotation about a fixed axis secured to said second arm member for frictionally engaging said camming surface of said bracket means, said anti-friction roller engaging said relatively short convex arcuate portion in the closed position of the door, such that said relatively short convex arcuate portion of said camming surface provides a relatively slight initial resistance to the opening of the door from the door closed position; and said lever acting on said camming surface is operative to counterbalance the door over a predetermined range, the counterbalancing effect of said lever increasing in the course of moving the door through the plurality of positions between the door closed position and the door open position to match the force delivered by said spring means as said spring means extends as the door moves from the door closed position to the door open position.

2. The hinge mechanism of claim 1 wherein said camming surface further includes:

stop means disposed adjacent said relatively long convex arcuate portion for engaging said second arm member of said lever for restraining the movement of said antifriction roller on said camming surface.

3. The hinge mechanism of claim 1 wherein the distance between said lever first end and said second arm member of said lever is at least as long as the length of said bracket means to thereby reduce the forces exerted by said anti-friction roller on said camming surface of said bracket means.

4. The hinge mechanism of claim 1 wherein said first arm member of said lever is angled toward the rear wall of said oven structure and said second arm member is angled toward the access opening such that said anti-friction roller is disposed intermediate the end of said first arm member of said lever and said first end of said lever.

* * * * *